United States Patent [19]

Helton

[11] Patent Number: 4,957,021

[45] Date of Patent: Sep. 18, 1990

[54] SELF-CONTAINED, HAND-HELD HYDRAULIC CLAMP/WRENCH

[76] Inventor: Darion L. Helton, 12421 I Whisper Hollow Dr., Maryland Heights, Mo. 63043

[21] Appl. No.: 355,469

[22] Filed: May 23, 1989

[51] Int. Cl.[5] ..... B25B 13/12

[52] U.S. Cl. ..... 81/57.44; 81/301

[58] Field of Search ..... 81/301, 57.44; 269/25, 269/26

[56] References Cited

U.S. PATENT DOCUMENTS

| | | | |
|---|---|---|---|
| 1,271,365 | 7/1918 | Reynolds, Jr. | 269/25 |
| 2,555,421 | 6/1951 | Ronan | 81/301 |
| 2,706,922 | 4/1955 | Allen | 81/301 |
| 2,948,174 | 8/1960 | Bourne | 81/301 |
| 4,689,957 | 9/1987 | Gallentine | 81/301 |

*Primary Examiner*—Roscoe V. Parker

*Attorney, Agent, or Firm*—H. John Barnett

[57] ABSTRACT

An improved, completely portable, self-contained hydraulically actuated clamp/wrench, which includes integral pump means in the handle. The clamp/wrench may be held and operated with one hand which makes it especially useful in cramped locations where it is difficult to reach both hands to open or close a manually adjustable wrench. The clamp/wrench includes a stationary jaw and a complementary, hydraulically movable jaw which firmly clamps a workpiece to permit application of maximum torque to free up frozen parts.

1 Claim, 1 Drawing Sheet

SELF-CONTAINED, HAND-HELD HYDRAULIC CLAMP/WRENCH

BACKGROUND

1. Field of the Invention

This invention is directed to an improved, completely portable, self-contained hydraulically actuated clamp, especially a portable, hand-held wrench. The hydraulically actuated jaws apply a greater clamping force to an object such as a nut or bolt. It is especially useful in cramped locations where it is difficult to reach with the hands to close or open a manually adjustable wrench.

2. Description of Related Art

The Mar. 9, 1964 issue of *Electrical World*, page 70 includes an advertisement showing several types of Hydraulic Cutters being marketed by H. K. Porter, Inc. of Somerville, Mass. The POWER Hydraulic Cutters shown there include hoses connected to a remotely located, hydraulic power unit. Also shown in the same reference is a HAND Hydraulic Cutter. This unit shows a hand-held cutter tool which is connected by a hydraulic hose to a hand-operated hydraulic pump which appears to sit on the floor when the unit is in use.

U.S. Pat. Nos. 3,561,117 and 4,369,576 describe hydraulic cutting tools similar to that shown in the *Electrical World*, in which a pair of hydraulic fluid hoses connect the cutters to a remotely located hydraulic pump means.

U.S. Pat. Nos. 4,141,261 and 4,339,968 are both directed to hydraulic wrench systems. U.S. Pat. No. 4,141,261 describes a completely self-contained hydraulic wrench system, but the system merely provides torque to a socket 120 of fixed size. There is no clamping action by the socket against the nut to be loosened or tightened.

U.S. Pat. No. 4,339,968 is also directed to a hydraulic wrench. However, this system appears to have an external, hydraulic fluid source which connects to the tool by means of a hydraulic hose. The hydraulically driven tool is a removal socket of fixed size, so there is no clamping action by the tool on the nut or bolt.

A self-contained, hand-operated hydraulic cutter is shown in Cooper Industries, Cooper Tools Division 1987 Industrial Tools Catalog No. 55341. This tool contains a two stage hydraulic pump in the forward end of the operating handle, immediately adjacent the bolt cutter head. The object is to develop high cutting torque with less effort. It appears that the hydraulic pump must be operated with both hands, and that both cutting jaws are connected to, and operated together, by the hydraulic system.

None of the above patents or references describe a self-contained, hand-held hydraulic clamp such as applicant's invention, which has a stationary jaw and a complementary hydraulically operated jaw which can be clamped firmly on a pipe, nut, or a bolthead so that mechanical torque can be applied through the stationary jaw handle without slipping, or without applying excessive pressure against the nut or bolthead which might cause it to deform (bolthead) or freeze in place (nut).

SUMMARY OF THE INVENTION

The hand-held, self-contained hydraulic clamp of the invention provides a firm clamping action on the part to be turned, such as a bolt, nut or pipe, and allows maximum, mechanical torque to be developed to free up frozen parts. The device comprises a stationary jaw integrally connected with the torque handle and a complementary hydraulically movable jaw having a portable hydraulic pump means disposed in the stationary jaw handle in such a way that the hydraulic clamp can be held in one hand, then positioned relative to the pipe, nut or bolthead and the movable jaw can be caused to move into clamping position by operating the hydraulic pump with the fingers of the same hand, leaving the other hand free.

The hydraulic pump means includes a convenient pump handle and valve means so that hydraulic pressure can be built up to a level causing the movable jaw to firmly clamp the pipe, nut, bolthead or other workpiece to be gripped and turned without deforming it. A relief valve is provided to prevent excess clamping pressure from being applied to the workpiece. In addition, a manually operable pressure release valve is provided to release the clamping action and disengage the workpiece. The hand-held, self-contained hydraulic clamp of this invention supplies the necessary gripping power and maneuverability to adapt it for use in many otherwise awkward applications. It is lightweight, relatively inexpensive and more versatile than other prior tools. It has more gripping power to loosen tight and frozen parts as compared to a crescent wrench. It will firmly hold different size piping better than a pipe wrench, and can be positioned and operated with one hand in a confined space. It has pinpoint gripping power like vise grips and clamping ability of an adjustable C-clamp with no slipping.

DESCRIPTION OF THE PREFERRED EMBODIMENT

Figure 1:
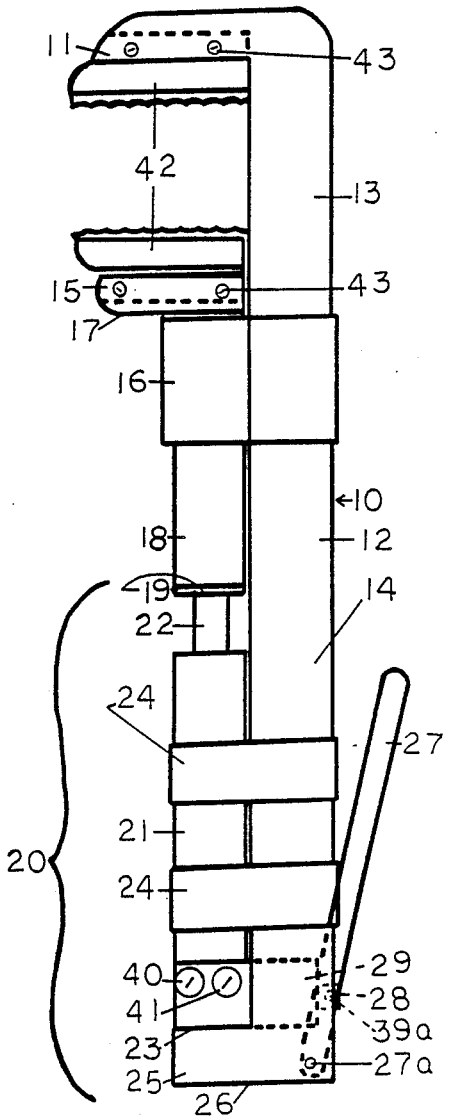
FIG. 1 is a side plan view of the hand-held, self-contained, hydraulic clamp of the invention.

A self-contained, hand-held hydraulic clamp/wrench 10 includes a stationary jaw 11 which extends generally perpendicular from an integral main body 12. The main body 12 includes an upper extension 13 and an elongated handle 14. A movable, lower jaw assembly 15 is slidably mounted on the handle 14 by means of a lower jaw assembly retainer 16, which is rigidly fastened to the handle 14.

The lower jaw assembly 15 includes a movable jaw 17 which is integrally connected to a slidable jaw extension 18, which is retained adjacent, and parallel to, the handle 14 of the main body 12 by the lower jaw retainer 16. As shown in FIG. 1, the movable jaw 17 is generally perpendicular to the slidable jaw extension 18 and in the same plane as the stationary jaw 11 to cooperate with it to clamp and hold a workpiece (not shown) when the workpiece is disposed between the jaws 11 and 17 and jaw 17 is moved towards jaw 11.

As shown in FIG. 1, lower end 19 of the jaw extension contacts a self-contained, hydraulic drive assembly 20 which includes hydraulic cylinder 21, piston rod 22 and hydraulic pump system 23. The hydraulic drive assembly 20 is firmly retained adjacent the lower end of handle 14 by means of suitable retainer straps 24, which can be removed to replace or repair the hydraulic drive assembly 20. An integral extension 25 is provided on lower end 26 of handle 14 to further support and cradle the hydraulic drive assembly 20.

Also disposed on the lower end 26 of the handle 14 is a pump handle 27 which is pivotally mounted in the lower end 26 of handle 14 by means of pin 27*a* to drive the hydraulic pump system 23. Hydraulic pump system 23 includes a pump piston rod 28 which is slidably received in pump cylinder 29. Manual operation of the pump handle 27 moves the pump piston rod 28 reciprocally in the pump cylinder 29 to build up hydraulic pressure in the hydraulic drive assembly 20 and thereby move the piston rod 22 upwardly against the lower end 19 of the lower jaw extension 18 and move the lower jaw 17 towards the stationary jaw 11 to firmly engage and clamp a workpiece.

Figure 2:
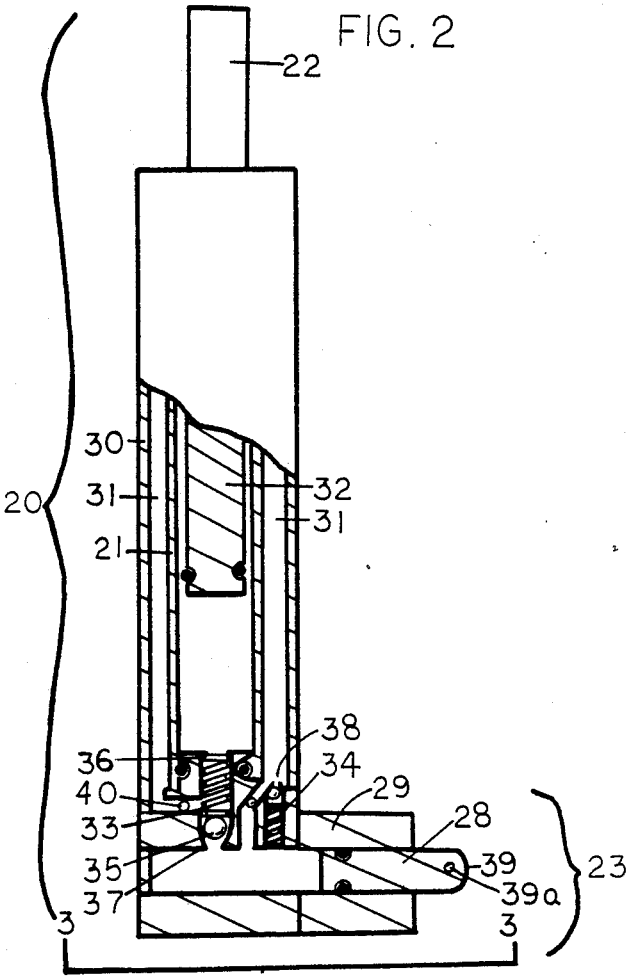
FIG. 2 is a side plan view, partially in section, showing the hydraulic system assembly used in FIG. 1.

As best seen in FIG. 2, showing the hydraulic drive assembly 20, the hydraulic cylinder 21 is disposed concentrically in a cylinder housing 30. The concentric space between the outside of hydraulic cylinder 21 and the inside of cylinder housing 30 defines a fluid reservoir 31.

The inner end of piston rod 22 defines a piston 32, which pushes the piston rod 22 out towards the jaw extension 18. Hydraulic pressure is applied against piston 32 through hydraulic pump system 23 by hand pumping hydraulic fluid from the fluid reservoir 31 into the hydraulic cylinder 21.

The hydraulic pump system 23 communicates with the hydraulic drive assembly 20 by means of a main pump passage 33 which supplies hydraulic fluid from the pump cylinder 29 to the hydraulic cylinder 21. A return passage 34 connects the fluid reservoir 31 to the pump cylinder 21 to provide additional hydraulic fluid to pump cylinder 21 as the pump piston 28 forces the piston 32 outwardly in the hydraulic cylinder 21.

The main pump passage 33 is provided with a ball check valve 35, normally biased by spring 36 against a ball seat 37, and closing the passage 33 against reverse flow of fluid from the hydraulic cylinder 21 into the pump cylinder 29. A similar ball check valve assembly 38 is provided in the return passage 34 which opens when the pump piston 28 is moved outwardly in pump cylinder 29, to allow fluid to enter the pump cylinder from fluid reservoir 31, and then closes when pump piston 28 moves inwardly to force hydraulic fluid into the pump cylinder 29.

Figure 3:
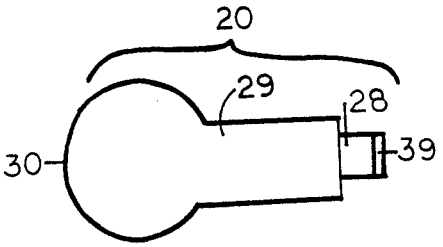
FIG. 3 is a bottom end view taken from line 3—3 of FIG. 2 showing the general contour of the hydraulic system assembly.

FIG. 3 of the drawings shows the generally cylindrical shape of the hydraulic drive assembly 20 defined by the cylindrical housing 30. As can be seen in FIG. 3, the pump cylinder 29 extends laterally outward from the base of the cylindrical housing 30. The outer end 39 of pump piston 28 extends laterally outward from the pump cylinder 29 to be actuated by pump handle 27, to which it is connected at pin 39*a*.

The hydraulic drive assembly 20 is also provided with a pressure release valve 40, shown at the base of cylindrical housing 30 which allows flow of hydraulic fluid from the hydraulic cylinder 21 back into the fluid reservoir 31 so that the movable jaw 17 can move away from the jaw 11 to release a clamped workpiece.

Included in the hydraulic pump system 23 is a handle release valve 41, which is opened to equalize hydraulic fluid pressure between the pump cylinder 29 and the fluid reservoir 31 so that the pump piston 28 can be moved inwardly, if required, to nest the pump handle 27 against the handle 14 while grasping the clamp/wrench 10 when clamped on the workpiece.

As seen in FIG. 1, the stationary jaw 11 and the movable jaw 17 may both be provided with complementary jaw inserts 42, held firmly in place by a plurality of threadably received set screws 43. Jaw inserts 42 may be provided in a plurality of shapes and sizes adapted to be inserted and fastened into the jaws 11 and 17 to increase the versatility of the clamp/wrench 10.

Other configurations of the self-contained, hand-held hydraulic clamp are contemplated. For example, the hydraulic cylinder assembly might be reversed, so that the hydraulic pump system is adjacent the lower jaw extension. The pull handle is then pivotally mounted on the pump cylinder housing and extends downwardly toward the base of the clamp/wrench handle. A pressure release valve and pump handle release valve would be provided as before so that the workpiece could be released, and so that the pump handle could be nested against the hydraulic cylinder to facilitate grasping the clamp/wrench handle.

Also contemplated is a sealed hydraulic drive system comprising a double-acting piston in which one surface of the piston is always exposed to hydraulic fluid at the fluid reservoir pressure, and the other side can be exposed to high fluid pressure by means of a manual pump system similar to that described above. As the piston moves in response to pump pressure, the fluid on the other side of the piston is displaced into the fluid reservoir, and becomes available to the pump. When the pressure relief valve is opened, the high pressure fluid can also move into the fluid reservoir, and the movable jaw released from the workpiece. Because the system is completely recirculating, it can be a sealed system, which avoids inspiration of air into the hydraulic fluid.

What is claimed is:

1. In an improved self-contained, hand-held hydraulic clamp/wrench having a main wrench body, a fixed jaw integral with an extending from said main wrench body, a lower, horizontal extension on said main wrench body, a movable jaw slidably connected to said main wrench body, said slidable jaw having a lower, vertically movable extension adapted to be driven by a hydraulic drive assembly, the improvement consisting of:

a completely self-contained, separable hydraulic drive assembly disposed adjacent, and removably secured to said main wrench body, said hydraulic drive assembly comprising in combination:

(1) a cylindrical housing defining a fluid reservoir and an integral hydraulic pump cylinder at the lower end of said housing, said housing having a vertical opening in the upper end and also having a check valve at the lower end of the housing;

(2) a hydraulic cylinder integral with said housing, said hydraulic cylinder being disposed axially inside and completely surrounded by the fluid reservoir, said hydraulic cylinder having a pressure relief valve communicating with said fluid reservoir, and also having a spring biased ball check valve axially disposed at its lower end;

(3) a pump cylinder integral with said housing and disposed with pg,9 its long axis perpendicular to the vertical axis of said housing, said pump cylinder communicating with said fluid reservoir through a normally open ball check valve, and with said hydraulic cylinder through a normally closed ball check valve;

(4) a pump piston rod slidably disposed in the pump cylinder, said pump piston rod having actuating means connected to its outer end to cause it to draw hydraulic fluid from the fluid reservoir on its outward stroke and to inject the hydraulic fluid under pressure into the hydraulic cylinder on its inward stroke;

(5) a piston disposed in the hydraulic cylinder which moves vertically upward in response to actuation of the hydraulic pump and consequent increase in hydraulic fluid in the hydraulic cylinder;

(6) a piston rod connected to the upper end of said piston, and extending axially out the upper end of the cylindrical housing through the vertical opening therein, said piston rod being urged into contact with the lower vertical extension of the movable jaw to urge the movable jaw towards the fixed jaw upon manual actuation of the hydraulic pump piston rod.

* * * * *